United States Patent [19]

Vandersall

[11] 4,447,336

[45] May 8, 1984

[54] STABILIZED GALACTOMANNAN GUM COMPOSITIONS

[75] Inventor: Howard L. Vandersall, Upland, Calif.

[73] Assignee: Monsanto Company, St. Louis, Mo.

[21] Appl. No.: 332,287

[22] Filed: Dec. 18, 1981

[51] Int. Cl.[3] ..... A62D 1/00

[52] U.S. Cl. ..... 252/7; 106/18.14; 106/18.17; 252/8.05; 536/121

[58] Field of Search ..... 106/18.18, 18.19, 18.14, 106/18.17; 252/7, 8.05, 8.5 A, 352; 536/114, 121

[56] References Cited

U.S. PATENT DOCUMENTS

| | | | |
|---|---|---|---|
| 3,146,200 | 8/1964 | Goldstein et al. | 252/8.5 |
| 3,301,723 | 1/1967 | Chrisp | 149/20 |
| 3,634,234 | 1/1972 | Morgenthaler | 252/7 |
| 3,950,159 | 4/1976 | Fox et al. | 252/352 X |
| 4,060,132 | 11/1977 | Chiesa, Jr. | 252/8.05 |
| 4,060,489 | 11/1977 | Chiesa, Jr. | 252/8.05 |
| 4,112,223 | 9/1978 | Lin et al. | 536/114 |
| 4,225,592 | 9/1980 | Lakatos et al. | 536/121 |

FOREIGN PATENT DOCUMENTS

| | | | |
|---|---|---|---|
| 2724162 | 8/1977 | Fed. Rep. of Germany | 252/603 |
| 2921306 | 11/1979 | Fed. Rep. of Germany | 252/603 |

*Primary Examiner*—Leland A. Sebastian

*Attorney, Agent, or Firm*—Jon H. Beusen; J. C. Logomasini; A. H. Cole

[57] ABSTRACT

Aqueous compositions thickened by galactomannan gums are described which are stabilized by soluble molybdenum.

21 Claims, No Drawings

STABILIZED GALACTOMANNAN GUM COMPOSITIONS

This application relates to galactomannan gum-thickened compositions and, particularly, to stabilization of such compositions against viscosity loss during storage, and more particularly, to the stabilization of galactomannan gum-thickened ammonium salt fire retardant compositions.

BACKGROUND OF THE INVENTION

Galactomannan gum thickeners are used where viscosity control of aqueous solutions or slurries is needed. For example, galactomannan gum thickeners are used to control the rheological properties of oil well drilling fluids and fire retardant compositions. When galactomannan gum-thickened aqueous compositions are stored for long intervals of time, viscosity loss sometimes occurs. The stability problem is more severe with compositions contacting steel apparently due to the destabilizing effect of ferrous ion. To extend storage stability of galactomannan gum-thickened compositions, the use of certain salts and of heavy metal ions have been proposed. See, for instance, U.S. Pat. Nos. 3,146,200 and 3,634,234. However, because of low efficacy of these known stabilizers, their use has not been commercially accepted. Therefore, improved stabilizers for galactomannan gum-thickened compositions are needed.

SUMMARY OF THE INVENTION

It has now been discovered that improved galactomannan gum-thickened aqueous compositions are obtained by incorporation of a stabilizing amount of soluble molybdenum. Viscosity stabilized compositions are obtained by dissolving a water-soluble molybdenum compound in a galactomannan gum-thickened aqueous composition. Any amount of soluble molybdenum compound sufficient to reduce viscosity loss of the composition during storage is suitable for the practice of this invention. Generally, a viscosity stabilizing amount of soluble molybdenum compound is added to provide from 0.00001 to 1 part by weight of molybdenum per 100 parts by weight of water. Expressed in parts per million (ppm), the amount of molybdenum is generally about 0.1–10,000 ppm, and preferably, the amount of molybdenum is about 1–500 ppm, and more preferably is about 1–100 ppm.

One embodiment of the invention comprises aqueous fire retardant compositions comprising ammonium phosphate fire retardant, a viscosity increasing amount of galactomannan gum thickener and sufficient water soluble molybdenum compound to reduce viscosity loss during storage of the composition. A typical composition comprises 1–20 parts by weight of ammonium phosphate fire retardant, 0.01 to 10 parts by weight of galactomannan gum thickener, 0.00001 to 1 part by weight of soluble molybdenum, and 100 parts by weight of water. All of the components of a fire retardant composition except water may be blended to form a concentrate, preferably, in powder form. The concentrate is then mixed with water and stored until needed. A typical concentrate comprises ammonium phosphate fire retardant, galactomannan gum thickener, and a viscosity stabilizing amount of a water soluble molybdenum compound. Generally, a concentrated composition of the invention comprises about 50 to 98 percent by weight of ammonium phosphate fire retardant, about 2 to 50 percent by weight of galactomannan gum thickener, and about 0.0001 to 1 percent by weight of a water soluble molybdenum compound. Preferred concentrated compositions comprise about 80 to 98 percent by weight of ammonium phosphate fire retardant and about 2 to 20 percent by weight of guar gum or ether derivatives of guar gum. Other components, typically in ammonium phosphate fire retardant compositions, may also be present, such as, corrosion inhibitors, bactericides, defoamers, colorants and flow conditions or other fire retardants such as ammonium sulfate.

One advantage of the soluble molybdenum stabilizers of the invention is that they are effective in the presence of materials which accelerate viscosity loss of galactomannan gum-thickened aqueous compositions. For example, iron and other transition metals exert a deleterious effect upon the storage stability of galactomannan gum-thickened aqueous compositions. This is believed due to the ability of these metals to cross-link galactomannan. See U.S. Pat. No. 3,301,723. Regardless of the mechanism, molybdenum inhibits the destabilization effect of these metals.

The molybdenum stabilizers of the invention are particularly effective in compositions having a pH of 8.0 or below. Preferred compositions are acidic, having a pH of about 4.0 to 7.5. Typical ammonium phosphate fire retardant compositions are acidic compositions having pH values within the preferred range.

The term galactomannan gum thickener as used herein refers to galactomannan gum and ether derivatives thereof which when added to water increase the viscosity of the resulting aqueous composition. Galactomannan gums are materials derived from a variety of leguminous plants such as locust beans and guar seeds. Galactomannan is a high molecular weight polysaccharide made up of many mannose and galactose units. The galactomannan gum molecule is essentially a straight chain mannan branched at regular intervals with galactose or mannose units. Derivatives of galactomannan gums are also valuable thickeners. Galactomannan gums may be substituted by addition of hydroxy alkyl or carboxy alkyl groups to the hydroxyl radical which resulting ether derivatives impart improved properties to the galactomannan gum. U.S. Pat. No. 4,272,414. The degree of etherification may vary from 0.01 to 0.9 moles. Normally, the degree of substitution is from 0.05 to 0.5. A preferred galactomannan gum thickener is guar gum or its ether derivatives. Typically, a viscosity increasing amount of galactomannan gum is about 0.01 to 10 parts by weight per 100 parts by weight of water. Preferably, about 0.1 to 5 parts by weight of galactomannan gum are used per 100 parts by weight of water.

Any ammonium phosphate fire retardant is suitable for the molybdenum stabilized galactomannan gum-thickened compositions of the invention. Examples of satisfactory fire retardants are an ammonium phosphate selected from the group consisting of monoammonium orthophosphate; diammonium orthophosphate; monoammonium pyrophosphate; diammonium pyrophosphate; triammonium pyrophosphate; tetraammonium pyrophosphate; ammonium polyphosphates; ammonium-alkali metal mixed salts of othro-, pyro-, and polyphosphates; ammonium-alkaline earth metal mixed salts of ortho-, pyro-, and polyphosphates; and mixtures thereof.

Any form of water-soluble molybdenum is suitable as a stabilizer for the practice of this invention. A preferred form of soluble molybdenum is a molybdate, for example, ammonium molybdate and alkali metal molybdate. Examples of satisfactory soluble molybdenum compounds are sodium molybdate, potassium molybdate, lithium molybdate, ammonium molybdate, molybdic acid, molybdic silicic acid, potassium molybdenum cyanate, molybdenum hydroxide, molybdenum oxychloride acid, molybdenum oxydichloride, molybdenum trisulfide, and complex forms of molybdate ion such as sodium-, ammonium-, and potassium-dimolybdates, trimolybdates, tetramolybdates, paramolybdates, tetramolybdates, octamolybdates, decamolybdates and permolybdates.

DESCRIPTION OF THE PREFERRED EMBODIMENTS

Fire retardant compositions are prepared by blending, to form a solid concentrate in powder form, monoammonium phosphate, guar gum, flow conditioner, colorant, defoamer agent, and corrosion inhibitor. An aqueous fire retardant composition is then formed by mixing the dry concentrate with water. Sodium molybdate is then added at various concentrations to portions of the above-described fire retardant composition. The compositions are stored at room temperature. A composition containing no stabilizer is a control. The viscosity of the compositions is monitored at various time intervals by using a Model LTF Brookfield viscometer, spindle No. 4 at 60 rpm. The stabilizing effect of molybdenum upon the viscosity of the compositions is shown in Table 1. The data show that the control composition containing no stabilizer has suffered a substantial loss in viscosity after 140 days (only 52% of initial viscosity) compared with 93% or greater retention of viscosity for the samples stabilized with molybdenum.

TABLE 1

FIRE RETARDANT COMPOSITION

| | (Parts by Weight) |
|---|---|
| Water | 100 |
| Monoammonium Orthophosphate | 10.56 |
| Guar Gum | 1.02 |
| Flow Conditioner | 0.24 |
| Colorant | 0.12 |
| Corrosion Inhibitor | 0.048 |
| Defoamer | 0.006 |
| Molybdenum Stabilizer | Varied |

| | | Viscosity, Centipoise | | |
|---|---|---|---|---|
| Sample No. | $Na_2MoO4.2H_2O$ | Initial 90 min. | 140 Days | % Retention |
| 1 | 0 | 2098 | 1100 | 52 |
| 2 | 0.006 (20 ppm Mo) | 2116 | 1970 | 93 |
| 3 | 0.012 (41 ppm Mo) | 2099 | 2037 | 97 |
| 4 | 0.024 (82 ppm Mo) | 2064 | 1970 | 95 |

The ability of molybdenum to stabilize galactomannan gum-thickened fire retardant compositions contaminated with iron is illustrated in Table 2. An iron-contaminated solution is prepared by immersing for 17 days a steel coupon into a non-stabilized fire retardant composition (same composition as control of Table 1).

TABLE 2

| | | | Viscosity, Centipoise | | |
|---|---|---|---|---|---|
| Sample No. | Iron sol., ml. | $Na_2MoO4.2H_2O$ (Parts by Weight) | Initial 90 min. | 140 Days | %, Retention |
| 1 | 10 | 0.0 | 2050 | 930 | 45 |
| 2 | 10 | 0.006 | 2077 | 1930 | 93 |
| 3 | 10 | 0.012 | 2060 | 1960 | 95 |
| 4 | 10 | 0.024 | 2030 | 1960 | 97 |
| 5 | 40 | 0.0 | 1927 | 767 | 40 |
| 6 | 40 | 0.006 | 1950 | 1750 | 90 |
| 7 | 40 | 0.012 | 1900 | 1770 | 93 |
| 8 | 40 | 0.024 | 1887 | 1750 | 93 |
| 9 | 80 | 0.0 | 1740 | 530 | 30 |
| 10 | 80 | 0.006 | 1790 | 1590 | 89 |
| 11 | 80 | 0.012 | 1730 | 1630 | 94 |
| 12 | 80 | 0.024 | 1740 | 1627 | 94 |

0.006, 0.012 and 0.024 parts by weight of $Na_2MoO4.2H_2O$ = 20, 41 and 82 parts by weight of molybdenum per million parts by weight of total composition, respectively.

Portions of the iron contaminated solution, in the amounts indicated, are added to 800 milliliter samples of freshly prepared fire retardant compositions containing the same components as described in Table 1. The compositions are stored at room temperature, and the viscosity is monitored as before. Initial viscosity is the viscosity measured 10 minutes after preparing the aqueous composition. The viscosity of the compositions after 140 days storage is shown in Table 2. Samples 1, 5, and 9 are controls containing no stabilizer. The other samples contain the indicated amounts of sodium molybdate dihydrate. The data show that as the amount of iron contaminated solution increases, that the viscosity retention of the compositions decrease from 45% to 30%, whereas, the contaminated compositions stabilized with 20 ppm of molybdenum retain from 93 to 89 percent of their initial viscosity. Compositions containing higher proportions of molybdenum show even greater viscosity retention.

The viscosity stabilization of aqueous ammonium phosphate fire retardant composition with different metals are illustrated in Table 3. The fire retardant composition is the same as in Table 1. The amount of metal compound added is varied to give a concentration in terms of metal ion content of 45 parts per million. The compositions are stored at room temperature for 170 days. The viscosity is monitored as before. The results are shown in Table 3.

TABLE 3

| | Viscosity(cps) | | |
|---|---|---|---|
| Stabilizer (45 ppm Metal) | Initial | 170 Days | %, Retention |
| None | 1657 | 233 | 14 |
| $MnSO_4$ | 1660 | 540 | 33 |
| $CoSO_4.7H_2O$ | 1640 | 322 | 20 |
| $CdSO_4$ | 1590 | 330 | 21 |
| $CuSO_4$ | 1627 | 190 | 12 |
| $Na_2MoO_4.2H_2O$ | 1680 | 1233 | 73 |

The data show that the viscosity of the control dropped to only 14% of its original value, whereas, the molybdenum stabilized composition exhibits 73% of its original viscosity. The other metals, manganese, cobalt, cadmium, exhibit some stabilization but copper is ineffective. The data show that molybdenum is two or more times more effective than the other metals.

Although the invention has been illustrated by typical examples, it is not limited thereto. Changes and modifications of the examples of the invention herein chosen for purposes of disclosure can be made which do not constitute departure from the spirit and scope of the invention.

The embodiments of the invention in which an exclusive property or privilege is claimed are defined as follows:

1. An aqueous fire retardant composition comprising an ammonium phosphate fire retardant selected from the group consisting of monoammonium orthophosphate; diammonium orthophosphate; monoammonium pyrophosphate; diammonium pyrophosphate; triammonium pyrophosphate; tetraammonium pyrophosphate; ammonium, polyphosphates; ammonium-alkali metal mixed salts of ortho-, pyro-, and polyphosphates; ammonium-alkaline earth metal mixed salts of ortho-, pyro-, and polyphosphates; and mixtures thereof, a viscosity increasing amount of galactomannan gum thickener, and, in an amount effective to reduce viscosity loss of the composition during storage, a water-soluble molybdenum compound.

2. The composition of claim 1 comprising 1–20 parts by weight of ammonium phosphate fire retardant, 0.01 to 10 parts by weight of galactomannan gum thickener, 0.00001 to 1 part by weight of soluble molybdenum compound, and 100 parts by weight of water.

3. The composition of claim 1 in which the galactomannan gum thickener is guar gum.

4. The composition of claim 3 in which the soluble molybdenum compound is ammonium or alkali metal molybdate.

5. The composition of claim 4 comprising about 1 to 100 ppm of molybdenum.

6. The composition of claim 5 in which the fire retardant is monoammonium orthophosphate, diammonium orthophosphate, or mixtures thereof.

7. The composition of claim 6 in which the soluble molybdenum compound is sodium molybdate.

8. A concentrated composition suitable for the preparation of storable aqueous fire retardant compositions comprising an ammonium phosphate fire retardant selected from the group consisting of monoammonium othophosphate; diammonium orthophosphate; monoammonium pyrophosphate; diammonium pyrophosphate; triammonium pyrophosphate; tetraammonium pyrophosphate; ammonium sulfate; ammonium polyphosphates; ammonium-alkali metal mixed salts of ortho-, pyro-, and polyphosphates; ammonium-alkaline earth metal mixed salts of ortho-, pryo-, and polyphosphates; and mixtures thereof, a galactomannan gum thickener, and, in an amount effective to reduce viscosity loss during storage of a galactomannan gum-thickened aqueous fire retardant composition, a water-soluble molybdenum compound.

9. The concentrated composition of claim 8 comprising about 50 to 98 percent by weight of ammonium phosphate fire retardant, about 2 to 50 percent by weight of galactomannan gum thickener, and about 0.0001 to 1 percent by weight of a water-soluble molybdenum compound.

10. The concentrated composition of claim 9 comprising about 80 to 95 percent by weight of ammonium phosphate fire retardant selected from the group consisting of monoammonium orthophosphate, diammonium orthophosphate, or mixtures thereof, and about 5 to 20 percent by weight of guar gum or ether derivative of guar gum.

11. A composition having improved storage stability comprising a galactomannan gum-thickened aqueous composition and, in an amount effective to reduce viscosity loss of the composition during storage, a water-soluble molybdenum compound.

12. The composition of claim 11 having a pH of 8.0 or below.

13. The composition of claim 12 in which the gum thickener is guar gum and the molybdenum compound is ammonium or alkali metal molybdate.

14. The composition of claim 13 in which the molybdenum compound is sodium molybdate.

15. The composition of claim 14 having a pH of about 4.0 to 7.5.

16. A method for preserving the rheological properties of a galactomannan gum-thickened aqueous composition which comprises incorporating therein, in an amount effective to reduce viscosity loss of the composition during storage, a water-soluble molybdenum compound.

17. The method of claim 16 which comprises incorporating into a composition comprising about 1–20 parts by weight of an ammonium phosphate fire retardant selected from the group consisting of monoammonium orthophosphate; diammonium orthophosphate; monoammonium pyrophosphate; diammonium pyrophosphate; triammonium pyrophosphate; tetraammonium pyrophosphate; ammonium polyphosphates; ammonium-alkali metal mixed salts of ortho-, pyro-, and polyphosphates; ammonium-alkaline earth metal mixed salts of ortho-, pyro-, and polyphosphates; and mixtures thereof, 0.01 to 10 parts by weight of galactomannan gum thickener, and 100 parts by weight of water, 0.00001 to 1 part by weight of water-soluble molybdenum compound.

18. The method of claim 17 wherein the ammonium phosphate fire retardant is ammonium orthophosphate, diammonium orthophosphate, or mixtures thereof.

19. The method of claim 18 wherein the galactomannan gum thickener is guar gum.

20. The method of claim 19 wherein the molybdenum compound is ammonium or alkali metal molybdate present in the amount to give 1 to 100 ppm of molybdenum.

21. The method of claim 20 wherein the molybdenum compound is sodium molybdate.

* * * * *